US009777755B2

(12) United States Patent
Lowe

(10) Patent No.: US 9,777,755 B2
(45) Date of Patent: Oct. 3, 2017

(54) LOCKING ACTUATOR WITH A COLLISION DETECTION SYSTEM FOR A LIFT

(71) Applicant: ADVANCE LIFTS, INC., St. Charles, IL (US)

(72) Inventor: Brian C. Lowe, Sycamore, IL (US)

(73) Assignee: ADVANCE LIFTS, INC., St. Charles, IL (US)

( * ) Notice: Subject to any disclaimer, the term of this patent is extended or adjusted under 35 U.S.C. 154(b) by 309 days.

(21) Appl. No.: 14/680,381

(22) Filed: Apr. 7, 2015

(65) Prior Publication Data

US 2016/0297643 A1 Oct. 13, 2016

(51) Int. Cl.
*B66B 5/02* (2006.01)
*F15B 15/26* (2006.01)
*B66B 17/34* (2006.01)

(52) U.S. Cl.
CPC ..... *F15B 15/26* (2013.01); *B66B 17/34* (2013.01)

(58) Field of Classification Search
CPC .. F15B 15/26; B66B 17/43; E05B 2017/0095; E05B 2047/0069; E05B 51/02; E05B 2051/026
See application file for complete search history.

(56) References Cited

U.S. PATENT DOCUMENTS 953,297 A * 3/1910 Sautter ..... B66B 17/34 187/331
958,580 A * 5/1910 Baumer ..... B66B 5/26 187/365
1,813,943 A * 7/1931 Mallison ..... E05B 51/02 292/144
2,848,069 A * 8/1958 Sanders ..... B66B 17/34 187/360
3,158,217 A * 11/1964 Johnson ..... G01G 19/02 177/134
3,282,449 A 11/1966 Buford
3,831,713 A * 8/1974 Clarke ..... B66F 7/00 187/203
4,076,104 A 2/1978 Bishop et al.
4,110,860 A 9/1978 Neff et al.
4,312,619 A * 1/1982 Anderson ..... B64F 1/32 180/14.2
4,470,625 A * 9/1984 Walsh ..... E05B 65/1066 292/201
4,488,326 A * 12/1984 Cherry ..... B66F 7/0625 14/69.5
4,659,121 A * 4/1987 McGee ..... E05B 47/0002 292/144
4,878,265 A * 11/1989 Nesbitt ..... E05B 47/0002 16/49
4,913,475 A * 4/1990 Bushnell ..... E05B 47/026 292/144
4,995,130 A 2/1991 Hahn et al.
5,111,546 A 5/1992 Hahn et al.
(Continued)

OTHER PUBLICATIONS

U.S. Appl. No. 14/641,869, filed Mar. 9, 2015.

*Primary Examiner* — Michael Riegelman
(74) *Attorney, Agent, or Firm* — Marshall, Gerstein & Borun LLP

(57) ABSTRACT

A locking actuator with a collision detection system for a lift is arranged to detect misalignment relative to a locking receptacle and to stop activation of the locking actuator when misalignment is detected.

17 Claims, 11 Drawing Sheets

(56) References Cited

U.S. PATENT DOCUMENTS

| | | | | |
|---|---|---|---|---|
| 5,460,460 | A | 10/1995 | Alexander | |
| 5,771,995 | A | 6/1998 | Cooney et al. | |
| 5,773,771 | A | 6/1998 | Chatham | |
| 5,915,909 | A | 6/1999 | Smith | |
| 5,941,347 | A | 8/1999 | Pfleger et al. | |
| 7,207,419 | B2 | 4/2007 | Fore et al. | |
| 8,006,751 | B2 | 8/2011 | Lambert et al. | |
| 8,540,214 | B2 | 9/2013 | Christian | |
| 8,689,945 | B2 | 4/2014 | Arai et al. | |
| 9,410,329 | B2 * | 8/2016 | Keersmaekers | B66B 9/02 |
| 2008/0169158 | A1 | 7/2008 | Lam | |
| 2009/0260925 | A1 * | 10/2009 | Schilling | B66B 9/02 187/269 |
| 2012/0169071 | A1 * | 7/2012 | Labarre | E05B 47/0012 292/143 |
| 2014/0158470 | A1 * | 6/2014 | Arai | B66B 17/34 187/355 |
| 2015/0314988 | A1 * | 11/2015 | Lowe | B66B 9/02 187/269 |

* cited by examiner

LOCKING ACTUATOR WITH A COLLISION DETECTION SYSTEM FOR A LIFT

FIELD OF THE DISCLOSURE

The present disclosure relates generally to a locking actuator with a collision detection system for a lift having a platform movable between different elevations and, more particularly, to a lift having a platform that is lockable to secure the platform at a selected one of the elevations.

BACKGROUND

Lifts are used in a variety of different applications to raise and lower objects and people from a first elevation to at least a second elevation. In an industrial setting (e.g., a factory or warehouse), a lift may be used to transport heavy machinery and pallets of goods to and from balconies, mezzanines, basements, and/or between floors. Three types of lifts commonly used in an industrial setting are vertical reciprocating conveyors (VRCs), elevators, and scissor lifts.

A VRC typically includes a platform that supports the cargo and a pair of spaced apart vertical guide columns which guide the platform along a vertical path between the lower and upper levels. Fewer or more vertical guide columns may be utilized by the VRC (e.g., three or four vertical guide columns) depending on the application and type of cargo. Some VRCs employ a single mast from which the platform is cantilevered. To change the height of the platform, most VRCs employ an automated pulley that is mounted on a crossbar spanning the vertical guide columns and connected to the platform via a belt or chain. In general, safety regulations limit VRCs to carrying cargo and not passengers.

An elevator generally includes an enclosed car having a retractable door, a counterweight, a hoistway or shaft through which the car travels, a drive system, and various safety features that prevent free fall such as brakes and a governor. The safety features and design of an elevator make it suitable for human passengers, but the costs of installing and maintaining the elevator as well as other functional limitations may outweigh the benefit of human passengers in some industrial applications.

Scissor lifts employ a plurality of linked, folding supports arranged in a crisscross pattern that form one or more pantograph assemblies to operatively connect the platform to a base. The platform is raised by applying pressure to at least one of the folding supports in a manner that elongates the crisscross pattern and thereby propels the platform vertically. Descent is accomplished by collapsing the crisscross pattern. The crisscross pattern of folding supports is fairly resistant to sway and thus results in a relatively stable platform. As such, regulations typically allow an operator of a scissor lift to ride on the platform together with the cargo.

One common way to power a scissor lift is to provide a hydraulic actuator that exerts pressure on one of the folding supports to move the folding support into an upright position. The other folding supports, by virtue of their linked connection to the actuated folding support, are also turned upright, thereby causing the entire crisscross pattern of folding supports to elongate and push the platform in the upward direction.

A conventional scissor lift may depend solely on the hydraulic actuator to maintain the platform in a raised position. Because of the tendency of hydraulic actuators to slowly lose pressure over time, stationing the platform at an upper level for an extended period of time may result in the platform descending below the upper level. Unintentional descent of the platform may occur, for example, if heavy cargo is left on the platform for prolonged periods (e.g., overnight). Unintentional descent may also occur if a critical component of the scissor lift is accidentally removed during repair or maintenance while the platform is raised.

An extendable and retractable locking pin may be used to prevent such unintentional descent of the platform. However, extending the locking pin when not properly aligned with a receiver may cause damage to portions of the lift.

SUMMARY

According to an aspect of the disclosure, a lift includes a locking actuator with a collision detection system arranged to detect misalignment relative to a locking receptacle and to stop activation of the locking actuator when misalignment is detected.

In some arrangements, the collision detection system may include a shiftable portion of the locking actuator shiftable relative to the platform from and at-rest position to a retracted position. A spring may be arranged to urge the shiftable portion toward the at-rest position. A Proximity switch may be arranged to automatically stop the locking actuator when the shiftable portion shifts to the retracted position. The shiftable portion may include a cylinder of the locking actuator. The cylinder may be a hydraulic cylinder.

According to another aspect of the disclosure, a locking actuator with a collision detection system includes a cylinder arranged to shift in a direction opposite an extension direction of a piston member from the cylinder when the piston member engages an obstruction during extension, the cylinder is urged in the extension direction, and a proximity switch is arranged to be activated in response to the cylinder shifting in the direction opposite the extension direction to automatically stop extension of the piston member from the cylinder.

In some arrangements, the cylinder may be arranged to be carried by a platform of the lift such that the cylinder may shift relative to the platform. The cylinder may be carried by a hanger coupled to the platform, wherein the hangar is arranged to allow the cylinder to shift relative to the platform. In one arrangement, a clevis may be coupled to the cylinder. The clevis may have a slotted opening. A pin may extend through the slotted opening. The pin may be coupled to the hanger or to another support member. The pin may slide within the slotted opening to allow the cylinder to shift relative to the hanger or other support member from an at-rest position to a retracted position. The clevis may be coupled to a closed end of the cylinder opposite an open end of the cylinder. The clevis may be coupled to a closed end of the cylinder opposite an open end of the cylinder. The open end of the cylinder may be carried by a second hanger such that the cylinder can shift relative to the second hanger.

In some arrangements, a spring may be arranged to urge the cylinder in the direction of extension of the piston member, which in some arrangements may be in a direction toward the at-rest position from the retracted position. The spring may be any type of resilient member sufficient to urge the cylinder in the direction of extension. The spring may be a coil spring. The spring may be coupled to a bracket or other support member that is arranged to be in a fixed position relative to the platform or other section of the lift. The bracket may be coupled to the hangers, and the spring may be disposed between and engage the bracket and the shiftable portion of the locking actuator, such as the clevis.

In some arrangements, the proximity switch may be a micro-switch. The proximity switch may be arranged to be in a fixed position relative to the platform or other section of the lift. The proximity switch may be carried by the bracket. And engagement finger may extend from the shiftable portion of the locking actuator, such as the clevis, toward the proximity switch. In the at-rest position, the engagement finger may be spaced apart from the proximity switch. In the retracted position, the engagement finger may operatively engage, such as by touching, the proximity switch.

In some arrangements, a control system is arranged to activate the locking actuator. The control system may be arranged to control the lift mechanism for raising and/or lowering the platform of the lift. The control system may include compressed fluid control components, such as hydraulic or compressed air. The control system may include analog and/or digital electronic control components. The control system may be responsive to input from a user and/or may have automatic control operations.

Additional aspects and arrangements of the disclosure will become apparent upon studying the following detailed description of an exemplary arrangement and the accompanying drawings.

DETAILED DESCRIPTION

Figure 1:
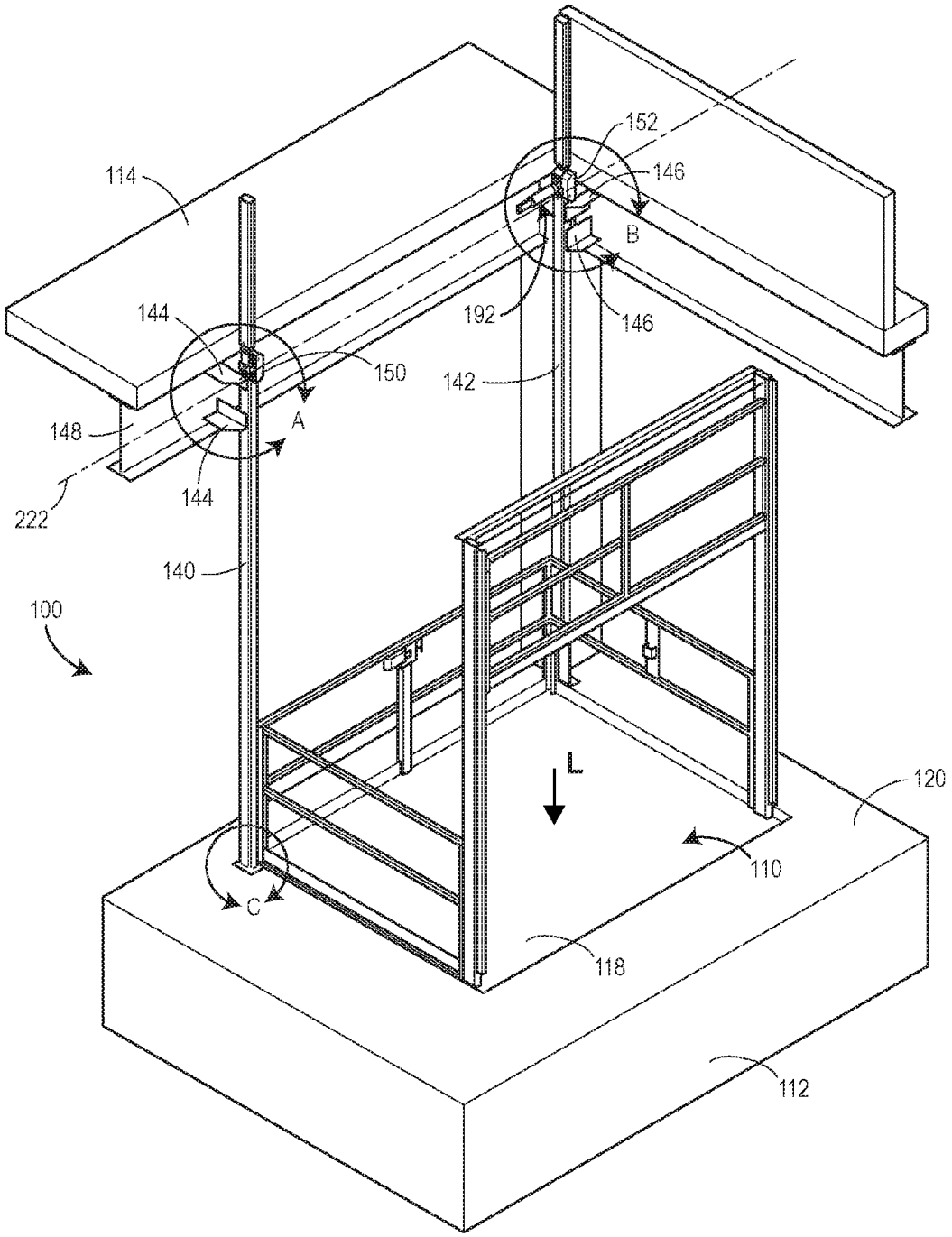
FIG. 1 is a perspective view of one embodiment of a lift in accordance with principles of the present disclosure having a platform in a lowered position.
Figure 2:
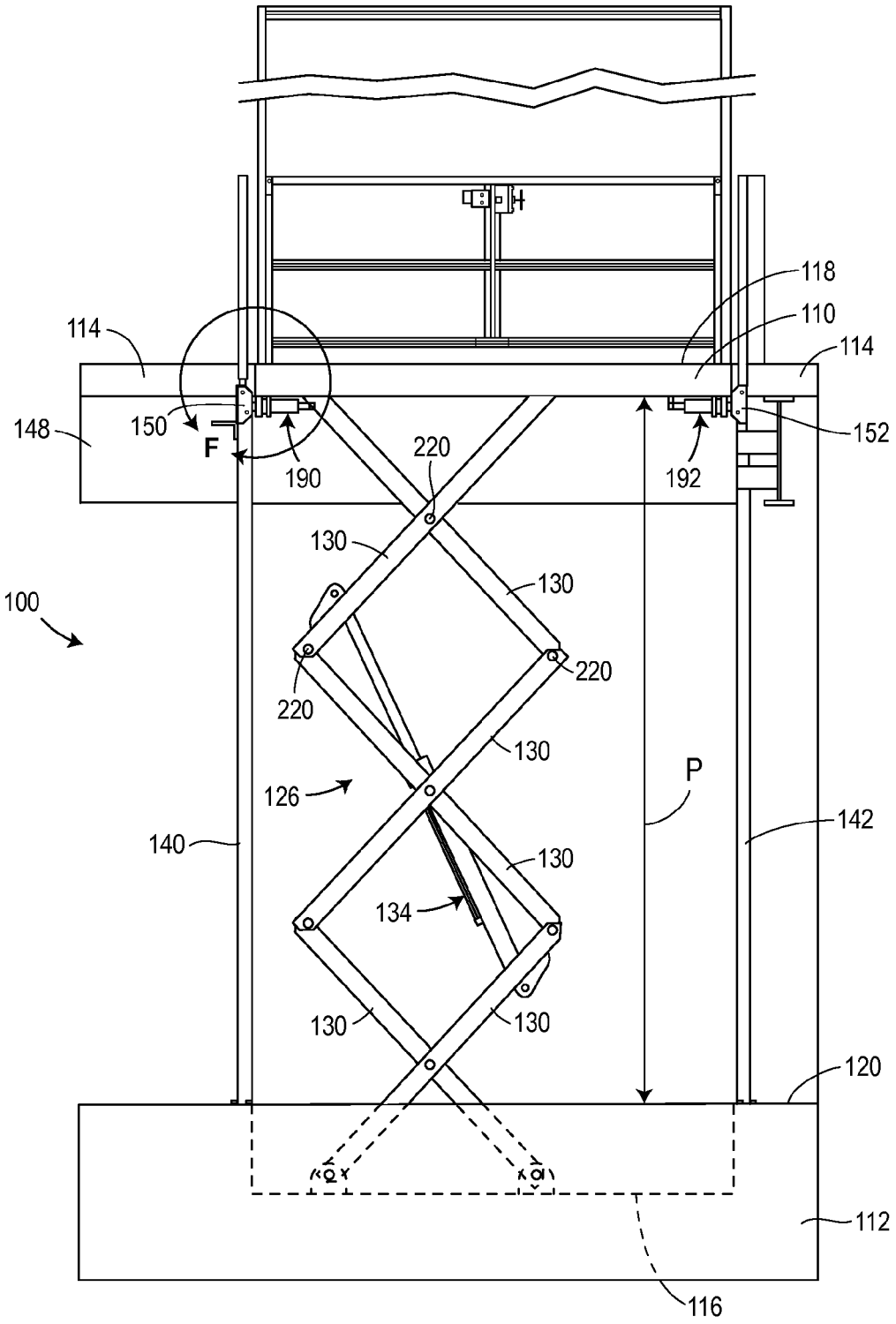
FIG. 2 is a side view of the lift illustrated in FIG. 1 with the platform in a raised position.

FIGS. 1 and 2 illustrate one embodiment of a lift 100 having a platform 110 movable between a ground level 112 and an upper level 114 along a lift path P (shown in FIG. 2). The platform 110 supports a load (denoted by "L" in FIG. 1). The ground level 112 may be formed with a recess or pit 116 into which the platform 110 is retracted, as illustrated in FIG. 1, so that an upper surface 118 of the platform 110 is flush with a floor surface 120 of the ground level 112. A lift mechanism 126 is used to raise and lower the platform 110 and, in the present embodiment, is formed by a plurality of pivotally connected scissor links 130 arranged in a crisscross pattern that form one or more pantograph assemblies and a hydraulic lift actuator 134. The lift actuator 134 is pivotally connected at opposite ends to two of the scissors links 130. When the platform 110 is lowered to the ground level 112, the scissor links 130 are folded on top of each other in a compact arrangement within the pit 116. Extension of the lift actuator 134 causes the scissor links 130 to unfold thereby elongating the crisscross pattern and propelling the platform 110 in the upward direction. To lower the platform 110, the lift actuator 134 is retracted, for example, by opening a valve that releases hydraulic fluid from a cylinder of the lift actuator 134, which causes the crisscross pattern of scissor links 130 to collapse under the weight of the platform 110 or otherwise. While the lift 100 of the present embodiment is configured as a scissor type lift, alternative embodiments can be arranged differently, for example, with the lift 100 configured as a vertically reciprocating conveyor (VRC) or as an elevator or any other vertically displaceable platform, as may be desired for any suitable purpose.

Still referring to FIGS. 1 and 2, the lift 100 of this version includes two spaced apart hollow support columns 140, 142 positioned adjacent to the platform 110 and which extend vertically alongside the lift path P. As shown in FIG. 1, brackets 144, 146 may fix each of the support columns 140, 142 to a support structure 148 (e.g., an I-beam) at the upper level 114 to provide the support columns 140, 142 with lateral stability. Fewer or more support columns than the two support columns illustrated in FIGS. 1 and 2 can be utilized by the lift 100. In one embodiment, four support columns can be utilized, with each support column being positioned adjacent to a respective corner of the platform 110.

Locking receptacles 150, 152 are positioned on each of the support columns 140, 142 at the upper level 114. As more clearly shown in FIGS. 10-14, each locking receptacle 150, 152 can include a lower mounting portion 156, a centrally located locking portion 160, and an upper accessory mounting portion 164. FIGS. 1-14 only show locking receptacle 152 for exemplary purposes, it being understood that locking receptacle 150 is preferably identical thereto. The mounting portions 156 are adapted to be inserted into top portions of the hollow support columns 140, 142, and subsequently fixed into position (e.g., by welding). The mounting portions 156 in one version can be approximately 3 inches in length to allow for some play such that the final vertical position of the receptacles 150, 152 relative to the corresponding support columns 140, 142 can be adjusted before welding. This allows for proper positioning of the receptacles 150, 152 relative to the upper level 114. An opening 174 is formed in an external wall 176 of the locking portion 160 that opens into a hollow interior of the locking receptacles 150, 152. The opening 174 is defined (e.g., bounded) on one side by a seating surface 180, which may be semi-cylindrical and/or have a tapered (e.g., frustoconical) entry surface to facilitate insertion of an object into the locking portion 160.

Figure 5:
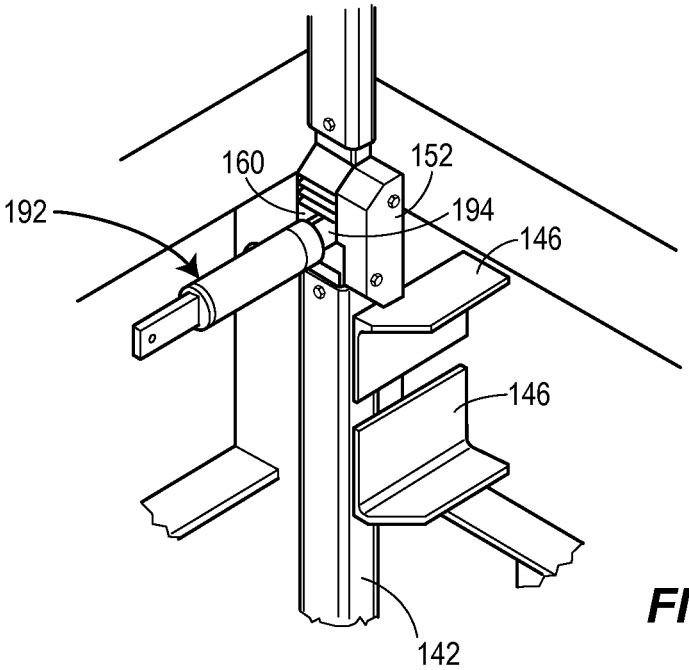
FIG. 5 illustrates an enlarged view of the portion of FIG. 1 enclosed by circle B.
Figure 6:
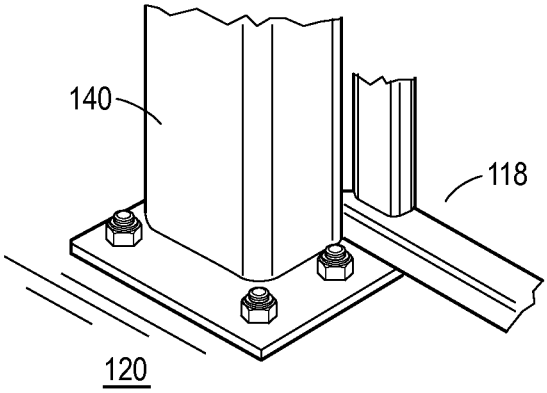
FIG. 6 is an enlarged view of the portion of FIG. 1 enclosed by circle C.
Figure 7:
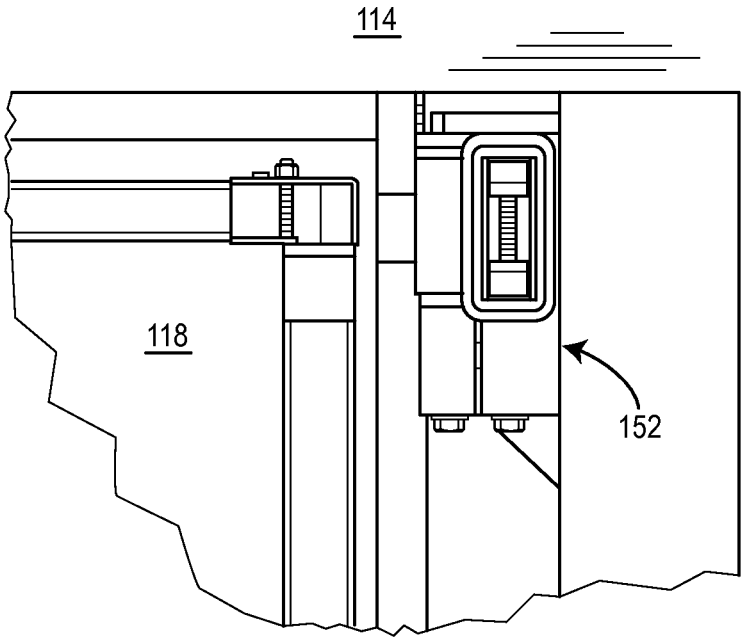
FIG. 7 is an enlarged view of the portion of FIG. 3 enclosed by circle D.
Figure 8:
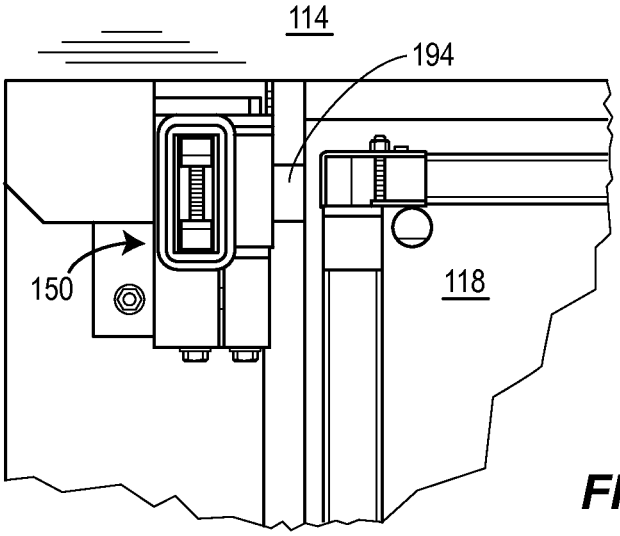
FIG. 8 is an enlarged view of the portion of FIG. 3 enclosed by circle E.
Figure 9:
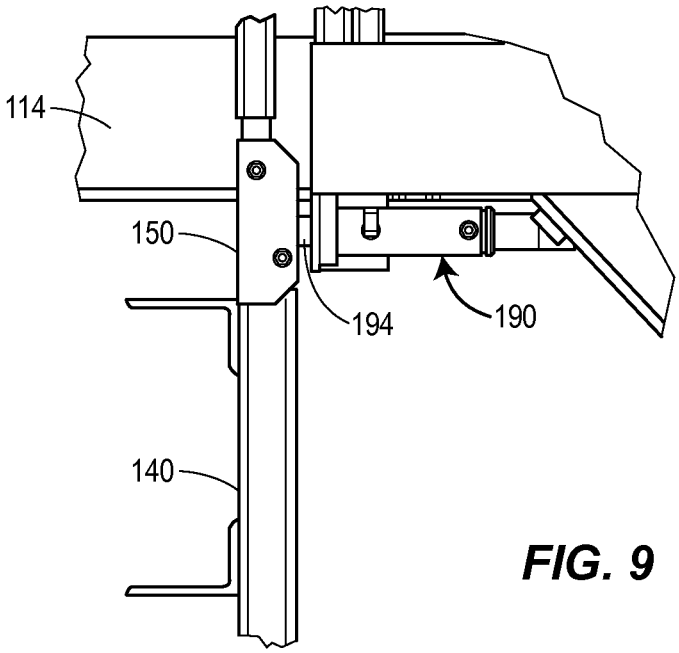
FIG. 9 is an enlarged view of the portion of FIG. 2 enclosed by circle F.
Figure 10:
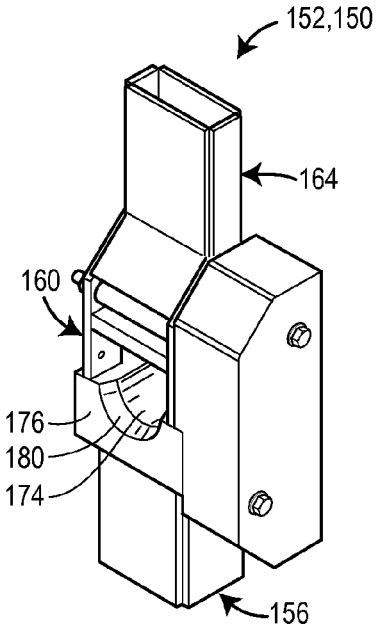
FIG. 10 is a perspective view of the front of a locking receptacle.
Figure 11:
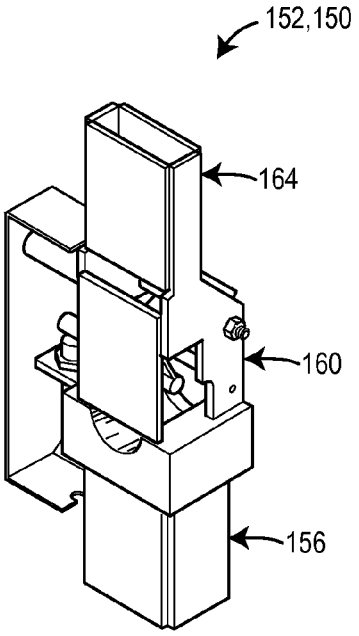
FIG. 11 is a perspective view of the rear of the locking receptacle shown in FIG. 10.
Figure 12:
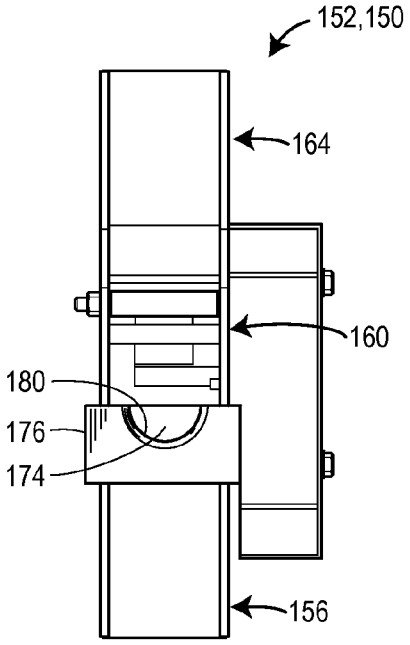
FIG. 12 is a front plan view of the locking receptacle illustrated in FIG. 10.
Figure 13:
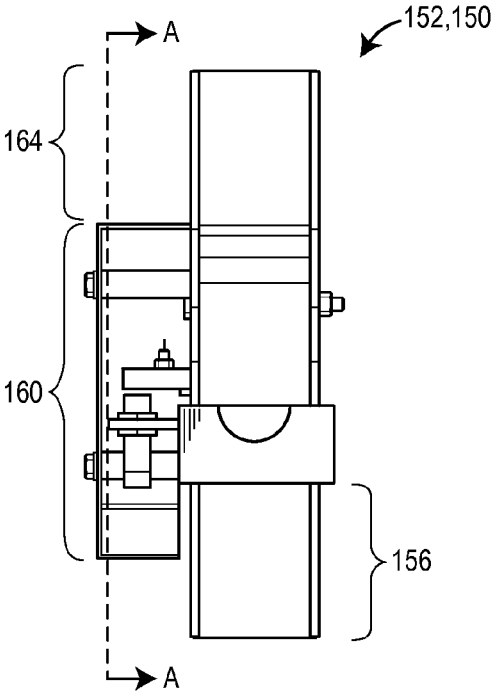
FIG. 13 is a rear plan view of the locking receptacle depicted in FIG. 10.
Figure 15:
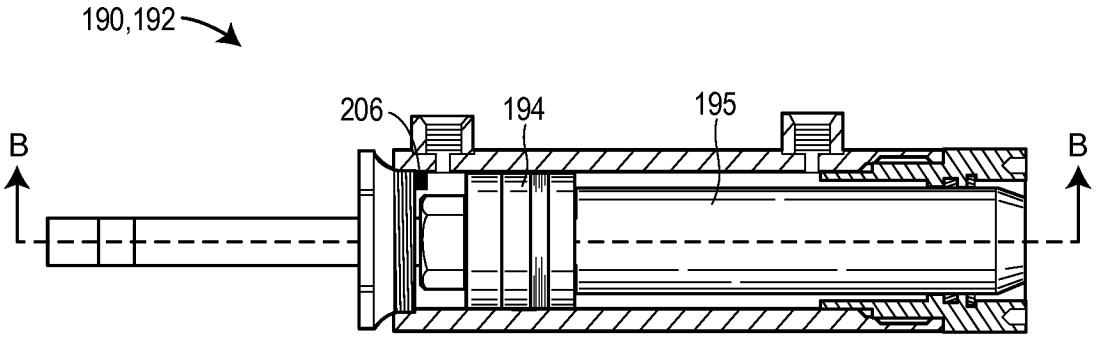
FIG. 15 is a side view of a hydraulic locking actuator.
Figure 16:
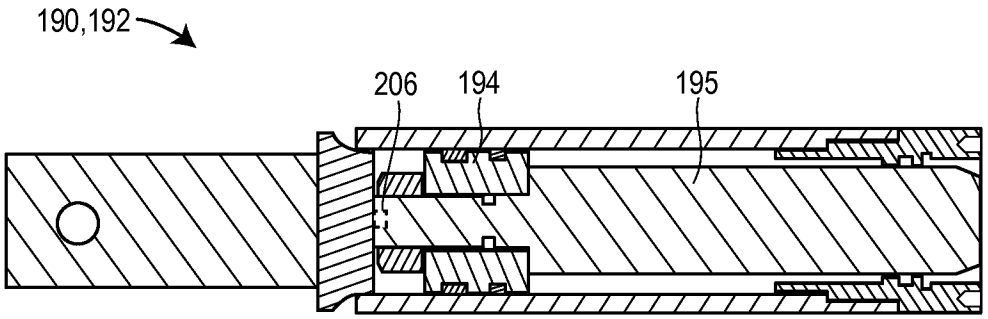
FIG. 16 is a cross-sectional view of the hydraulic locking actuator of FIG. 15 taken along line B-B.

Referring again to FIG. 2, two hydraulic locking actuators 190, 192 are fixed to an underside of the platform 110. As shown in FIGS. 15 and 16, for example, each locking actuator 190, 192 includes a piston member 194 that is movable along a direction substantially perpendicular to the lift path P. In the disclosed version, the piston member 194 includes a rod portion 195 extending from a distal end thereof that has a tapered (e.g., frustoconical) end to facilitate insertion into the respective receptacle 150 or 152, as will be described. In one embodiment, the locking actuators 190, 192 are supplied with hydraulic fluid from the same source that supplies the lift actuator 134. When the platform 110 is positioned at the upper level 114, the piston member 194 of the hydraulic actuator 170 is substantially aligned with the opening 174 formed in the exterior wall 176 of the locking receptacle 150 so that the piston member 194 can be extended into the hollow interior of the locking receptacle 150, as shown in FIG. 9. Similarly, the piston member 194 of the hydraulic actuator 192 is substantially aligned with the opening 174 in the exterior wall 176 of the locking receptacle 152 so that the piston member 194 can be extended into the hollow interior of the locking receptacle 152, as seen in FIG. 5. As discussed below in more detail, after the piston members 194, 196 have been inserted into their respective locking receptacles 150, 152, the platform 110 may be lowered by a small distance, e.g., approximately 0.25 to approximately 1.5 inches, to ensure that the piston members 194 rest securely on their respective seating surfaces 180. The engagement of the piston members 194 and the locking receptacles 150, 152 secures the platform 110 to the support columns 140, 142 and thereby prevents the platform 110 from unintentionally sinking below the upper level 114 due to, for example, hydraulic pressure leakage from the lift actuator 134.

In this embodiment, because the receptacles 150, 152 are fixed to the support columns 140, 142, respectively, and the tops of the support columns 140, 142 are fixed to the support structure 148 at the upper level 114, the interlocking of the piston members 194 with the respective receptacles 150, 152 also prevents the platform 110 from displacing horizontally away from the support structure 148. For example, in one embodiment, the locking actuators 190, 192 are positioned so that the cargo passes between the locking actuators 190, 192 when the cargo is loaded/unloaded from the platform 110 at the upper level 114. This configuration of the locking actuators 190, 192 inhibits the platform 110 from swaying due to lateral forces exerted by movement of the cargo on and off of the lift platform 110 because lateral movement of the piston members 194 is prevented by the receptacles 150, 152, which effectively retain the piston members 194 in position.

Figure 14:
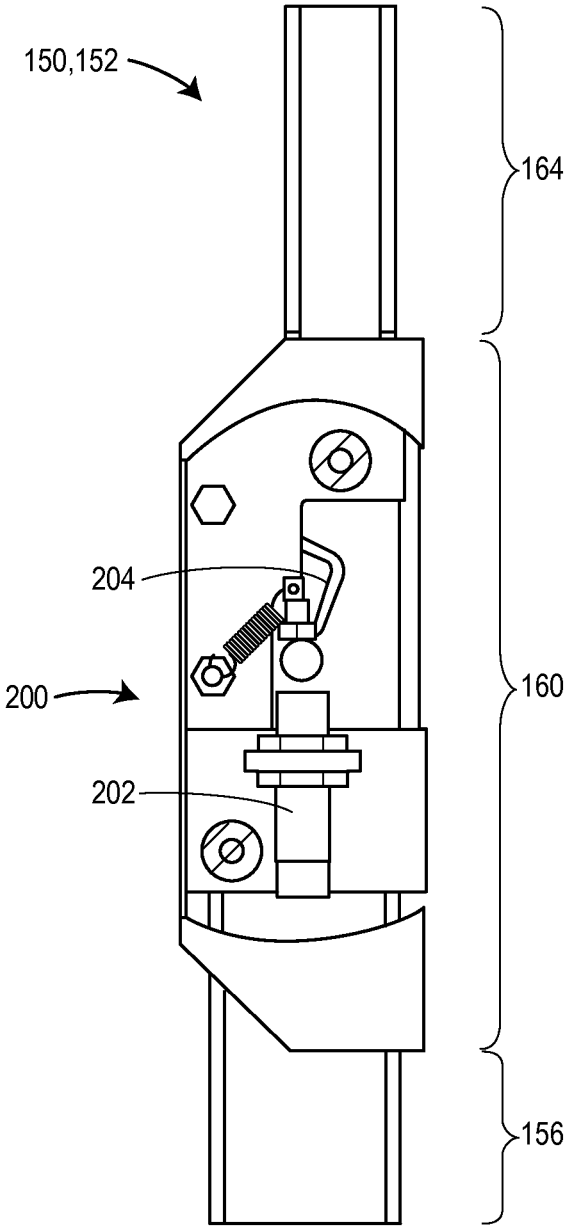
FIG. 14 is a cross-sectional view of the locking receptacle of FIG. 13 taken along line A-A.

Generally, during a raising operation of the lift 100, an operator depresses and optionally holds an "UP" button on a control panel (not illustrated) associated with the lift 100. This causes a controller to energize a hydraulic pump that supplies the lift actuator 134 with pressurized hydraulic fluid. The lift actuator 134 exerts pressure on the lift mechanism 126 thereby causing the lift mechanism 126 to elongate and push the platform 110 in the upward direction along the lift path P. The platform 110 keeps moving upward until it triggers an upper travel limit sensor. The upper travel limit sensor is positioned so that the platform 114 overshoots the upper level 114 by a small distance (e.g., in a range of approximately 0.25 inches to approximately 1.5 inches), but so that the piston members 194 of the actuators 190, 192 are substantially aligned with the locking receptacles 150, 152. The controller then causes the two locking actuators 190, 192 to extend their respective piston members 194 through the respective openings 174 in the locking receptacles 150, 152. When fully extended, the piston members 194 trigger an electronic position sensor assembly arranged to sense when the piston members 194 are fully or properly extended into the locking receptacles and/or to sense when the piston members 194 are properly seated on the seating surfaces 180. As shown in FIG. 14, in one exemplary arrangement, the electronic position sensor assembly includes electronic position sensors 200 located inside the locking receptacles 150, 152. Each position sensor 200 may include a proximity sensor 202 and a spring-biased rotatable sensor arm 204. In the position shown in FIG. 14, the sensor arm 204 is in an at-rest position adjacent the proximity sensor 202, such that the proximity sensor 202 senses the sensor arm 204. The arms 204 are pivoted out of the at-rest positions and thereby away from the proximity sensors 202 when axial ends of the piston members 194 are inserted into the locking receptacles 150, 152 and contact the sensor arms 204. When the sensor arms 204 have pivoted a predetermined amount to an engaged position, the proximity sensors 202 can no longer detect the presence of the sensor arms 204, and the controller confirms that the piston members 194 are fully extended into the receptacles 150, 152. In addition to relying on the position sensors 200 to confirm the extended position of the piston members 194, the system can also be equipped with pressure switches 206, as shown in FIGS. 15 and 16, mounted either in the cylinders that contain the piston members 194, or on hydraulic feed lines to those cylinders. Such pressure switches 206 can detect when the piston members 194 are fully extended and fully retracted relative to the cylinders, thereby giving the controller another, i.e., redundant, level of confirmation that not only do the position sensors 200 in the receptacles 150, 152 indicate that the piston members 194 should be fully extended, but the pressure switches 206 can confirm that in fact the piston members 194 are fully extended. This two-sensor confirmation arrangement can advantageously eliminate any concern of debris possibly being present between the ends of the piston members 194 and the respective pivoting sensor arms 204 of the position sensors 200 in the receptacles 150, 152, which could provide a false reading.

With the piston members 194 fully extended, the controller then operates the lift actuator 134 to lower the platform 110 until the piston members 194 become seated on the seating surfaces 180. As the piston members 194 are lowered onto the seating surfaces 180, the axial ends of the piston members 194 slide out of contact with the pivoting sensor arms 204 of the position sensors 200, which in turn allows the springs to automatically bias the sensor arms 204 back into the at-rest position illustrated in FIG. 14. In this position, the proximity sensors 202 can again detect the presence of the sensor arms 204, thereby providing an indication that the piston members 194 are fully seated on the seating surfaces 180. The platform 110 may be lowered by approximately 0.25 inches to approximately 1.5 inches or some other distance during this phase of the operation. Thus, in this exemplary arrangement, the position sensors 200 help ensure (1) that the piston members 194 have been properly extended into the locking receptacles 150, 152 and (2) that the piston members 194 have been properly seated on the seating surfaces 180.

During a lowering operation, the operator depresses and optionally holds a "DOWN" button on the control panel. Initially, the platform 110 moves in the upward direction until each of the piston members 194 triggers the position sensor 200 located within the respective locking receptacles 150, 152. That is, as mentioned, the pivoting sensor arms 204 of the position sensors 200 will have returned to their home positions depicted in FIG. 14 upon the piston members 194 becoming seated on the seating surfaces 180. Therefore, as the platform 110 and piston members 194, 196 are raised again, the axial ends of the piston members 194 re-engage the sensor arms 204 and force the sensor arms 204 to pivot away from the proximity sensors 202. This causes the proximity sensors 202 to no longer be able to sense the presence of the sensor arms 204, which indicates to the controller that the piston members 194 are sufficiently raised out of contact with the seating surfaces 180. At this point, the controller stops upward movement of the platform 110, retracts the piston members 194 back into their respective cylinders, and then operates the lift actuator 134 to lower the platform 110. The platform 110 continues to move downward until a lower limit sensor at the ground level 112 is triggered.

In another exemplary arrangement, the functionality of the single position sensor 200 in the electronic position sensor assembly may be divided into multiple electronic sensors in communication with the controller. For example, in another arrangement, the electronic position sensor assembly a first position sensor that may be provided to detect when the piston member 194 is properly extended into the locking receptacle 150 or 152, and a second position sensor that may be provided to detect when the piston member 194 is properly seated on the seating surface 180. The controller receives signals from the position sensor 200 or position sensors and controls movement of the lift as described herein based on the received signals.

In the present embodiment, the support columns 140, 142 are not utilized as guide rails to keep the platform 110 from deviating from the lift path P. The platform 110 is free from contact with the support columns 140, 142 as the platform 110 travels along the lift path P. It is only when the platform 110 is locked into position at the upper level 114 that the platform 114 becomes operatively engaged to the support columns 140, 142 and support structure 148. Other embodiments of the lift 100 can be arranged differently, for example, with the support columns 140, 142 having tracks that receive rollers attached to the sides of the platform 110 to guide the platform along the lift path P.

Additionally, while the foregoing disclosure focuses on fixing the platform 110 only at a single elevated height (i.e., the upper level 114 of the support structure 148), the system could also be configured to lock the platform at multiple heights to multiple different support structures such as floors, mezzanines, or otherwise.

Further yet, while the locking system has been disclosed as including piston members 194 that cooperate with receptacles 150, 152, other types of locking systems could be used to accomplish similar objectives without necessarily departing from the scope of the disclosure.

Further still, while the disclosed configuration includes the receptacles 150, 152 fixed to vertical support columns 140, 142 that extend from the floor surface 120 up to the upper level 114, where they are fixed to the support structure 148, alternative configurations could foreseeably include the receptacles 150, 152 being fixed directly to the support structure 148 at the upper level 114. In this type of configuration, it is possible that no vertical support columns 140 or 142 would be needed.

Figure 3:
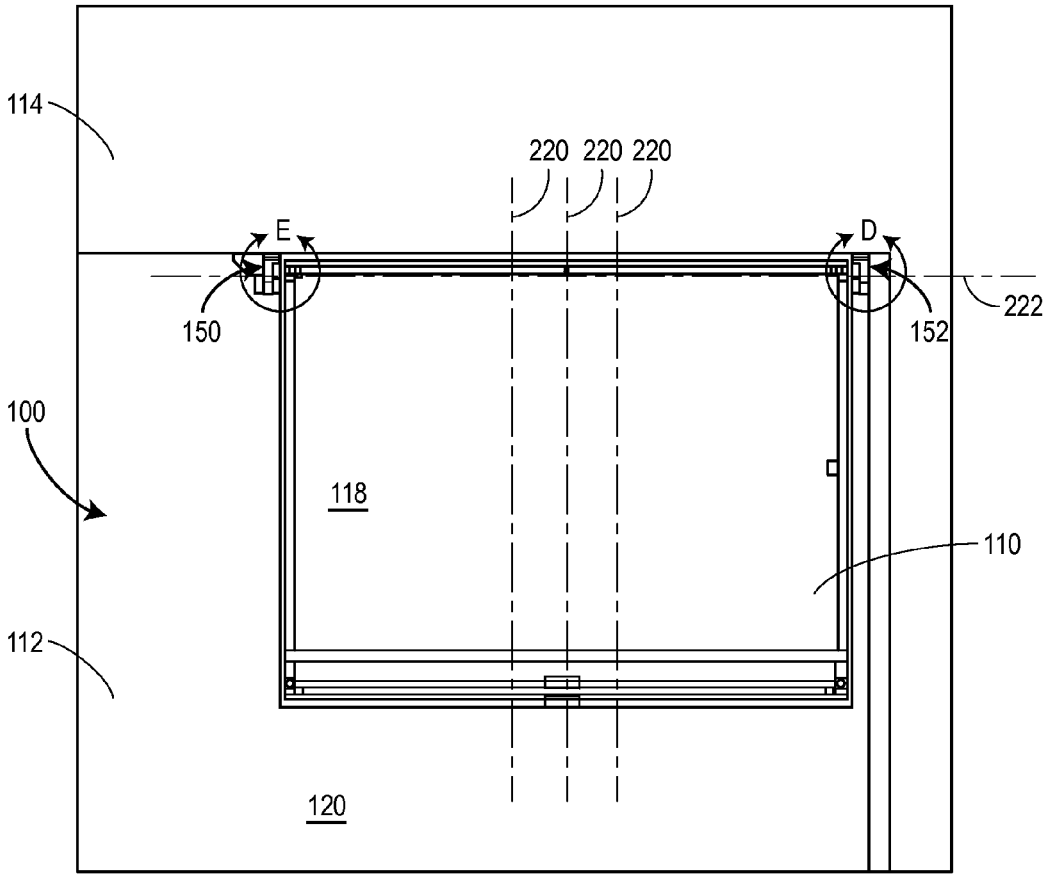
FIG. 3 is a top view of the lift illustrated in FIG. 1 in the raised position of FIG. 2.
Figure 4:
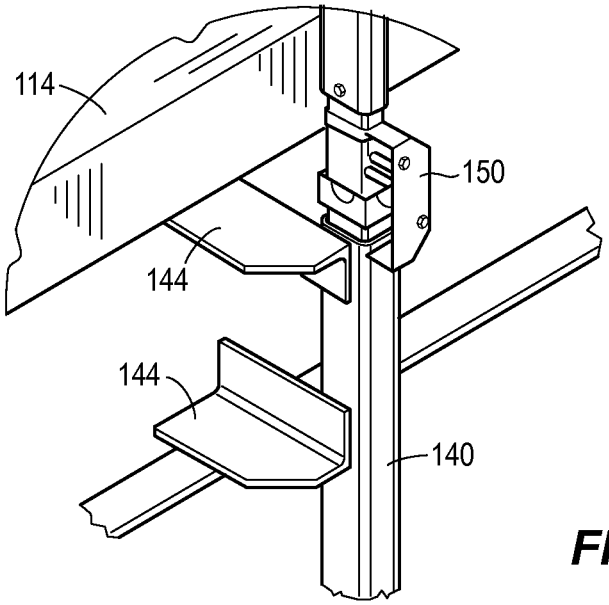
FIG. 4 depicts an enlarged view of the portion of FIG. 1 enclosed by circle A.

The platform 110 is preferably held in a horizontally fixed orientation, i.e., not capable of pivoting or tilting or being pivoted or tilted from its fixed orientation at all times, at least when the piston members 194 are securely resting on their respective seating surfaces 180. More preferably, the platform 110 is held in its horizontally fixed orientation at all positions between the lowered position and the raised position. The lift mechanism 126 is connected to the platform 110 in such a manner that the platform 110 is not able to pivot or tilt when the platform 110 is locked into position at the upper level by means of interaction between the piston members 194 and the locking receptacles 150, 152, as described above. For example, in the exemplary arrangement of the figures, the scissor links 130 are pivotably connected to pivot about one or more axes 220. The axes 220 are all oriented parallel to each other in a single direction. In comparison, the locking receptacles 150, 152 are oriented along a second axis 222, which is not parallel to the axes 220. Preferably, the axes 220 are all oriented horizontally and aligned in a front-to-back orientation, as depicted in FIG. 3. Also preferably, the axis 222 is oriented horizontally and aligned in a side-to-side orientation. For example, the axis 222 is preferably perpendicularly oriented in a horizontal plane relative to the axes 220. However, in other arrangements, the second axis 222 may be oriented parallel to the axes 220. In the exemplary arrangement of the figures, the piston members 194 of the hydraulic actuators 190, 192 are axially aligned along the axis 222, although the piston members 194 do not necessarily need to be so aligned. Thus, when the piston members 194 are locked into the respective locking receptacles 150, 152, the interaction between the lift mechanism 126, the platform 110, and the locking receptacles 150, 152 helps ensure that the platform 110 is maintained fixed in its horizontal orientation without being able to pivot or tilt in case the lift mechanism 126 were to shift slightly downwardly over time, for example, due to a loss of hydraulic pressure. This arrangement may improve the stability of the lift 100 and/or help maintained the platform 110 in a preferred preselected fixed horizontal orientation.

Turning now to FIGS. 17-20, a lift 250 has a locking actuator 252 with a collision detection system 254 in accordance with some aspects of the present disclosure. The collision detection system 254 is arranged to detect misalignment of the locking actuator 252 relative to a locking receptacle, such as the locking receptacles 150, 152, and to prevent extension of the locking actuator 252 when such misalignment is detected. Thus, in some arrangements, the collision detection system 254 of the locking actuator 252 may prevent the locking actuator 252 from damaging portions of the lift, such as portions of the locking actuator 252, the locking receptacles 150, 152, the platform 254, support columns 140, 142, support structure 148, and/or the upper level 114.

Figure 17:
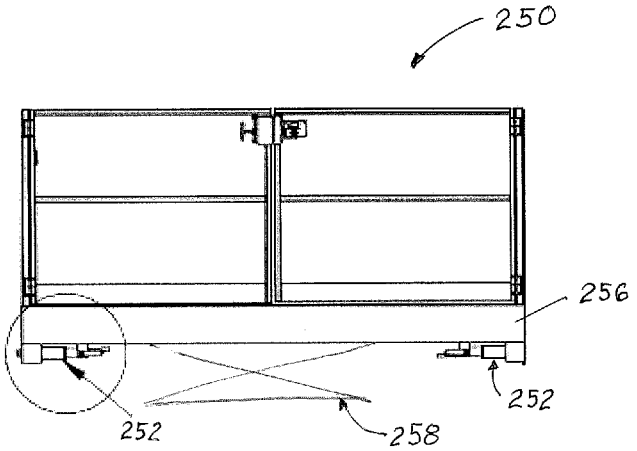
FIG. 17 is a side view of a platform of a lift including a locking actuator with a collision detection system.

As best seen in FIG. 17, the lift 250 includes a platform 256 arranged to support a load thereon and a lift mechanism 258 to raise and/or lower the platform. The platform 256 is arranged to have the load easily loaded and/or unloaded thereon. In the present example, the platform 256 is arranged substantially horizontally such that the load will not readily roll or slide off of the top surface of the platform. Further, the platform 256 is arranged to move up and/or down between at least two, and in some cases more than two, different elevations, so as to be able to move the load up and/or down from one of the elevations to another of the elevations, similar to the embodiment of FIG. 1. In the present example, the platform 256 is substantially the same as the platform 110 of the lift 100 described previously; however, other forms of platforms suitable for supporting a load as described previously may be used, and the platform 256 is not otherwise limited to any particular form. Additional details relative to the platform 110 are preferably similar to those already described herein above.

The lift mechanism 258 may be any lift mechanism suitable for raising and lowering the platform 256 under a given set of requirements. For example, the lift mechanism 258 may be the scissors-type lift mechanism 126 or any of the lift mechanisms disclosed herein. The lift mechanism may be arranged and configured to selectively raise and/or lower the platform 110 between two or more different elevations in response to control signals in any way described herein and/or known in the art.

Figure 18:
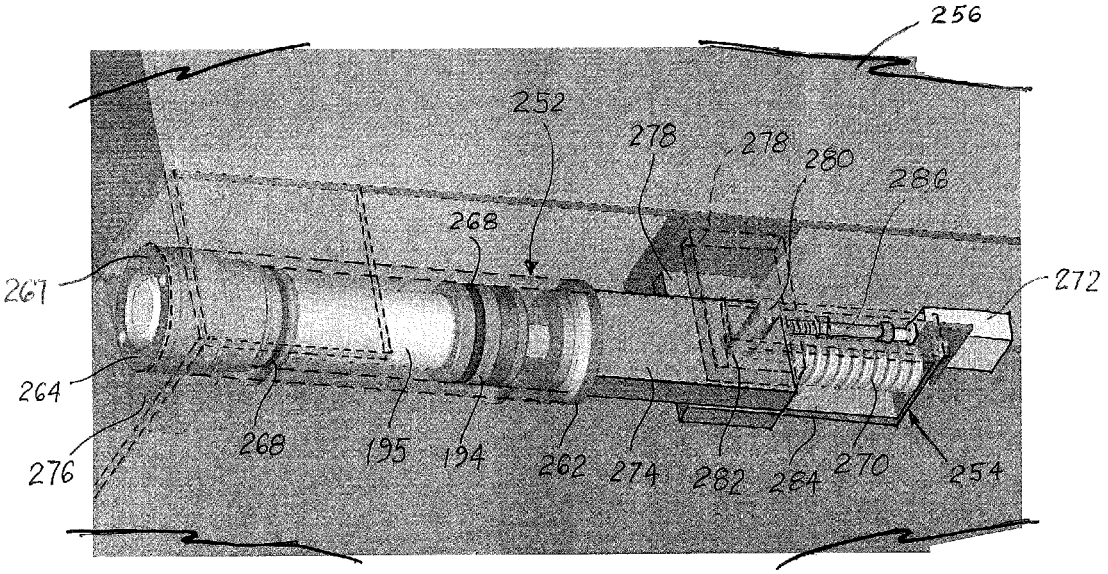
FIG. 18 is an enlarged perspective view of the locking actuator of FIG. 17.
Figure 19:
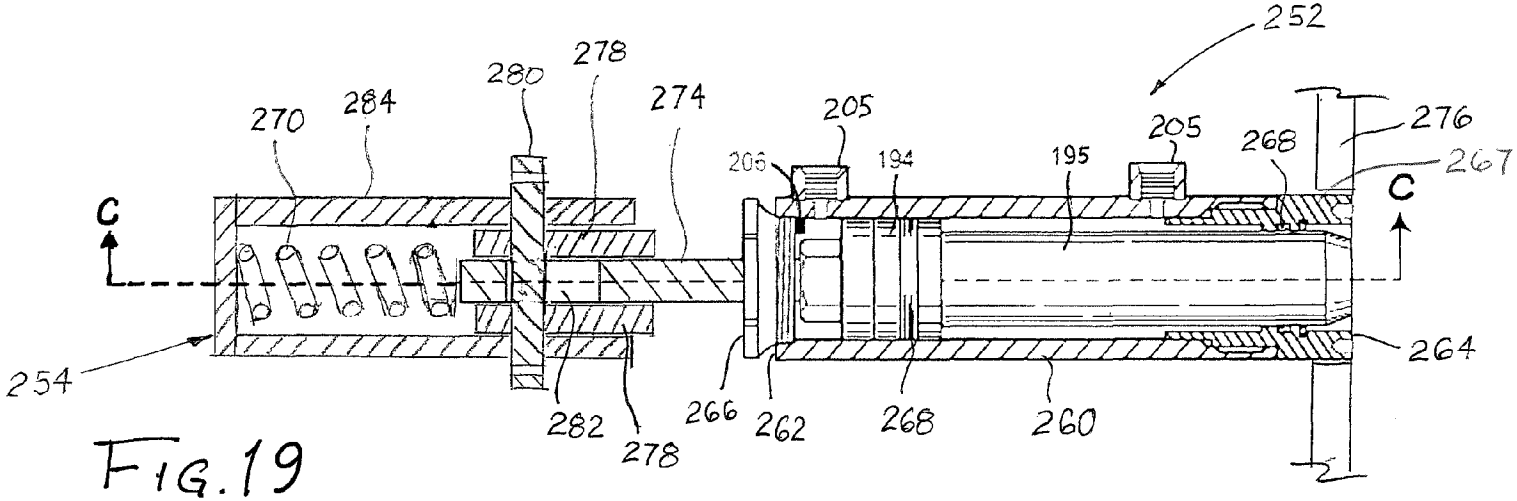
FIG. 19 is a partial cross-sectional view of the locking actuator of FIG. 18.
Figure 20:
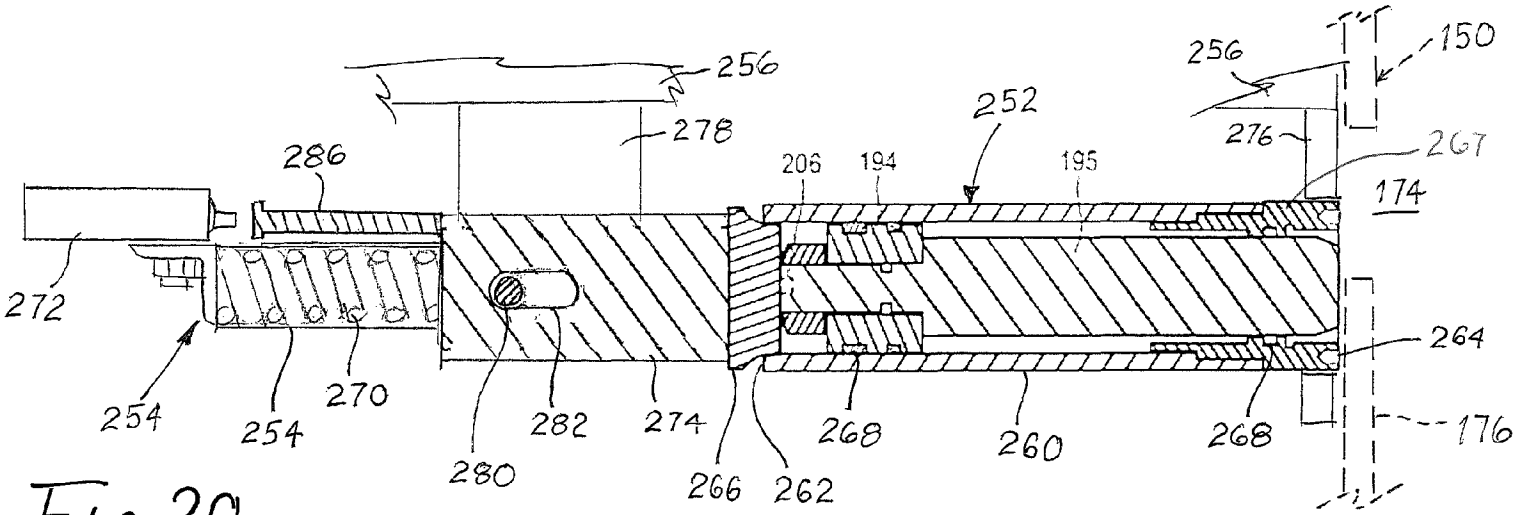
FIG. 20 is a cross-sectional view of the locking actuator along the lines C-C in FIG. 19.

As best seen in FIGS. 18-20, the locking actuator 252 is similar to the locking actuator 190, in that it includes a piston member that is disposed in a cylinder and arranged to be extended and/or retracted from the cylinder in response to pressurized fluid, such as hydraulic fluid, being pumped into or out of the cylinder. However, the locking actuator 252 also includes the collision detection system 254. The locking actuator 252 need not necessarily be actuated by hydraulic pressure, but may be actuated by other actuation means, such as a pressurized air, a gear, a servo motor, magnetic forces, or other suitable means for shifting a locking pin between an extended position for being received in a lock receiver to prevent movement of the platform 256 and a retracted position that allows movement of the platform 256.

In the present example, the locking actuator 252 includes a cylinder 260 having a closed end 262 and an open end 264. In the present arrangement, the closed end 262 is closed with a cap 266 that is welded or otherwise permanently attached to the left end of the cylinder 260 so as to close the closed end 262 of the cylinder 260. However, the closed end 262 may be closed with other closure, such as an end wall that is either removable or non-removable from the cylinder. The open end 264 is defined by a threaded collar 267, having external threads, which is threaded into the opposite end of the cylinder 260. The threaded collar 267 is thereby removably coupled to the cylinder 260 for ease of assembly and/or later future servicing of internal components inside the cylinder 260. However, in other arrangements, the open end 264 may not include the threaded collar 267, but may have a permanently coupled end-piece or may be formed by the end of the cylinder 260 itself without a separate collar piece. The piston member includes a piston 194 that sealingly and slidingly engages the interior wall of the cylinder 260, for example with a first seal 268, and a locking pin 195 that extends laterally from the piston 194 toward the open end 264. A second seal 268 disposed near the open end 264 forms a seal between the inner wall of the cylinder 260 and the locking pin 195. First and second fluid ports 205 through the wall of the cylinder 260 are disposed on opposite axial sides of the piston 194 along the length of the cylinder 260. Thus, when fluid is pumped into the left fluid port 205 and pumped out of the right fluid port 205, increased fluid pressure to the left of the piston 194 urges the piston 194 to the right and thus extends the nose of the locking pin 195 out of the open end 264 of the cylinder 260. Similarly, pumping fluid into the right fluid port 205 and pumping fluid out of the left fluid port 205 urges the piston 194 to the left and thus retracts the nose end of the locking pin 194 back into the cylinder through the open end 264. The fluid for activating the piston member may be any suitable fluid, such as air, oil, water, or other similar fluid. Thus, the locking actuator 252, in some arrangements, is a hydraulic locking actuator, as previously described herein. The locking actuator 252 may optionally include a pressure switch 206, as described previously herein.

The collision detection system 254 includes a shiftable portion of the locking actuator, a spring 270, and a proximity switch 272. The shiftable portion of the locking actuator is shiftable, such as laterally relative to the support columns 140 and 142, relative to the platform 256. The shiftable portion of the locking actuator can shift from an at-rest position, as shown in each of FIGS. 17-20, to a retracted position. In the exemplary arrangement of the drawings, the shiftable portion of the locking actuator includes the cylinder 260, the cap 266, and a clevis 274 connected to the cap; however, the shiftable portion of the locking actuator may include additional or other portions of the locking actuator 252 that can shift relative to the locking pin 195 and/or the piston 194. The cylinder 260 is shiftably carried by a hanger 276 disposed near the open and 264 of the cylinder 260 and by a pair of hangers 278 slidably connected to the clevis 274 with a pin 280 disposed through a slotted opening 282 through the clevis 274. Although a pair of hangers 278 on opposite sides of the clevis 274 is shown in the drawings, only one hanger 278 could also be used. Preferably, the hanger 276 includes an opening there through that receives the open end 260 of the cylinder 264. The cylinder 264 rests in the opening and can slide laterally back-and-forth in the opening. In addition, the clevis 274 rests on the pin 280 and can slide back and forth on the pin 280 along the length of the slotted opening 282 between the at-rest position, as illustrated in the drawings, and a retracted position as explained hereinafter. Thus, the cylinder 260, the cap 266, and the clevis 274 can shift back and forth laterally on the pin 280 and the hanger 276 relative to the platform 256 and the support columns 140, 142.

The spring 270 and the proximity switch 272 are maintained in a fixed position relative to the platform 256 such that the shiftable portion of the locking actuator 252 also shifts relative to the proximity switch 272 while the spring 270 urges the shiftable portion toward the at-rest position shown in the drawings. In the exemplary arrangement of the drawings, a bracket 284 is fixedly coupled to the hangers 278, and the proximity switch 272 is carried by the bracket 284. In this arrangement, the bracket 284 is U-shaped with left and right arms coupled to respective left and right hangers 278 with the pin 280 so as to extend axially away from the cylinder 260 and the clevis 274, and a base portion connected to the opposite ends of the arms is spaced longitudinally away from the end of the clevis 274. The spring 270 is disposed between and engages the base portion of the bracket 284 and the end of the clevis 274, thereby urging the clevis 274 and thus the cylinder 260 into the at-rest position, which, as seen in FIGS. 19 and 20, is to the right (the same direction that the locking pin 195 extends outwardly from the cylinder 260), until the left end of the slotted opening 282 engages the pin 280. In the at-rest position, the proximity switch 272 is not activated by the shiftable portion of the locking actuator 252. In the exemplary arrangement, the shiftable portion also includes an engagement finger 286 that extends from the end of the clevis 274 away from the cylinder 262 toward the proximity switch 272. In the at-rest position, the distal end of the engagement finger 286 is spaced apart from the proximity switch 272 a distance sufficient to prevent activation of the proximity switch 272.

As best seen in FIG. 20, when the locking actuator 252 is misaligned with the locking receptacle 150 such that the locking pin 195 is not aligned with the opening 174 into the locking receptacle 150, but rather is aligned with an exterior surface of, for example, the locking receptacle, such as the external wall 176 of the mounting portion 174, or even a surface of the support columns 140, the locking pin 195 will shift to the right (as seen in FIGS. 19 and 20) until it engages the exterior surface. If the locking actuator 252 were to be fixedly attached to the platform 256, the locking pin 195 at this point would continue to press against the exterior surface and possibly bend the exterior surface, thereby damaging the lift 250. However, with the locking actuator 252 including the collision detection system 254, when this occurs, the shiftable portion of the locking actuator, which in this instance includes the cylinder 260, the cap 266, and the clevis 274, will shift to the left (as seen in the FIGS. 19 and 20) on both the hanger 276 and the pin 280 along the axis of the slotted opening 282 into the retracted position. This is possible because the spring 270 develops a maximum spring force that is less than an actuation force, such as a hydraulic force, developed by the piston member within the cylinder 260. In the retracted position, the engagement finger 286 operatively engages the proximity switch 272, either by touching the proximity switch or by coming close enough to the proximity switch to activate the switch. In response to the proximity switch 272 being activated, the control system for the locking actuator 252 immediately stops the extension cycle of the piston member from the open and 264 of the cylinder 260, thereby preventing or significantly reducing any damage to the external wall 176 or other component of the lift against which the locking pin 195 presses. When this happens, the control system can be operated, either automatically or by an operator, to retract the piston member back into the cylinder 260, at which time the elevation of the platform may be adjusted so as to be aligned with the opening 174 and/or the piston member may again be extended to try to extend the locking pin 195 into the opening 174. In this way, the collision detection system 254 protects the lift 250 from misalignments of the locking actuator 252 with the locking receptacles 150, 152 that could otherwise damage the locking actuator 252 and/or the locking receptacle 150 and/or the support columns 140.

In one exemplary arrangement, the locking actuator 252 is in the form of a hydraulic cylinder that develops approximately 750 pounds of hydraulic force during the extension cycle to extend the locking pin 195 out of the open end 264 of the cylinder 260. The rate of extension of the locking pin 195 is relatively slow, for example, having an extension cycle with a period of approximately 2-5 seconds or more to extend the locking pin 195 approximately 1-2 inches. In contrast, the spring 270 has a preload force urging the cylinder 260 toward the nose of the locking pin 195 of approximately 100-150 pounds spring force. The slotted opening 282 in the clevis 274 is approximately one quarter inch long from the left end to the right end. The cylinder 260 is not secured or fixedly attached to the hanger 276. Therefore, because the spring force is less than the hydraulic force developed by the hydraulic cylinder, when the nose of the locking pin 195 engages an obstruction, such as the external wall 176 of the locking receptacle 150, the cylinder 260 can slide for example up to one quarter inch laterally away from the nose of the locking pin 195 (to the left as seen in FIGS. 19 and 20) toward the proximity switch 272, at which point the engagement finger 286 activates the proximity switch 272, which in turn causes the control system to stop further extension of the locking pin 195 from the cylinder 260.

While the present disclosure has been described with respect to certain embodiments, it will be understood that variations may be made thereto that are still within the scope of the appended claims.

What is claimed is:

1. A lift, comprising:

a platform to support a load thereon and to be loaded and unloaded, the platform being movable between a first elevation and a second elevation;

a lift mechanism configured to selectively raise the platform from the first elevation to the second elevation;

a locking actuator carried by the platform, wherein the locking actuator comprises:

a piston member extendable and retractable from a cylinder to selectively engage a locking receptacle disposed adjacent the platform at least at one of the first elevation and the second elevation; and a collision detection system to detect misalignment of the piston member relative to the locking receptacle and to automatically stop extension of the piston member when misalignment of the piston member is detected.

2. The lift of claim 1, wherein the collision detection system comprises:

a shiftable portion of the locking actuator shiftable relative to the platform, wherein the shiftable portion shifts from an at-rest position to a retracted position in response to the piston member engaging a portion of the locking receptacle other than the locking receptacle;

a spring arranged to urge the shiftable portion of the locking actuator toward the at-rest position from the retracted position; and a proximity switch arranged to automatically stop extension of the piston member in response to the shiftable portion of the locking actuator shifting to the retracted position from the at-rest position.

3. The lift of claim 2, wherein the cylinder is supported by the platform and arranged to shift laterally relative to the platform, the cylinder having an open end and a closed end, and the piston member disposed inside the cylinder, wherein the shiftable portion of the locking actuator comprises the cylinder.

4. The lift of claim 3, wherein the shiftable portion of the locking actuator comprises a clevis coupled to the cylinder, the clevis including a slotted opening;

a hanger is fixedly coupled with the platform; and a pin is coupled to the hanger and extends through the slotted opening to support the locking actuator, wherein the clevis slides on the pin along the slotted opening when the cylinder shifts from the at-rest position to the retracted position.

5. The lift of claim 4, wherein the proximity switch is fixedly coupled with the hanger.

6. The lift of claim 5, wherein a bracket is coupled to the hanger and the proximity switch is coupled to the bracket.

7. The lift of claim 6, wherein the spring engages the bracket and the clevis to urge the cylinder toward the at-rest position.

8. The lift of claim 1, wherein the piston member comprises:

a piston disposed inside the cylinder and arranged to shift axially along the cylinder in response to a fluid pressure within the cylinder; and a locking pin coupled to the piston to be extended out of and withdrawn into the open end of the cylinder by the piston in response to axial shifting of the piston.

9. The lift of claim 1, wherein the shiftable portion of the actuator comprises an engagement finger, wherein the engagement finger engages the proximity switch when the shiftable portion is in the retracted position.

10. A locking actuator with a collision detection system, comprising:

a piston member extendable in a first direction from a cylinder to selectively engage a locking receptacle, the cylinder being urged in the first direction;

a hanger arranged to shiftably carry the cylinder such that the cylinder can shift in a second direction opposite the first direction when the piston member engages an obstruction during extension of the piston member from the cylinder;

a proximity switch arranged to be activated in response to the cylinder shifting in the second direction, wherein activation of the proximity switch automatically stops extension of the piston member from the cylinder.

11. The locking actuator of claim 10, further comprising a spring arranged to urge the cylinder in the first direction.

12. A locking actuator with a collision detection system, comprising:

a cylinder;

a piston member disposed inside the cylinder to be extendable and retractable from the cylinder to selectively engage a locking receptacle;

a clevis coupled to the cylinder, the clevis having a slotted opening;

a hanger to be coupled to a platform;

a pin coupled to the hanger and extending through the slotted opening, wherein the pin slides within the slotted opening to allow the cylinder to shift relative to the hanger from an at-rest position to a retracted position;

a spring arranged to urge the cylinder toward the at-rest position from the retracted position; and a proximity switch arranged to be activated in response to the cylinder shifting to the retracted position;

wherein activation of the proximity switch automatically stops extension of the piston member from the cylinder.

13. The locking actuator with a collision detection system of claim 12, wherein the cylinder is operatively connected to a pressurized fluid to extend and retract the piston member from the cylinder, wherein the pressurized fluid develops a maximum extending force in the cylinder to extend the piston member, wherein the spring develops a maximum spring force on the cylinder to urge the cylinder toward the at-rest position, and wherein the maximum extending force is greater than the maximum spring force.

14. The locking actuator with a collision detection system of claim 13, wherein the cylinder has an open end and a closed end, the piston member is extendable and retractable through the open end, and the clevis is coupled to the closed end.

15. The locking actuator with a collision detection system of claim 13, wherein the piston member comprises a piston disposed inside the cylinder and arranged to shift axially along the cylinder in response to a fluid pressure within the cylinder, and a locking pin coupled to the piston to be extended out of and withdrawn into the open end of the cylinder by the piston in response to axial shifting of the piston.

16. The locking actuator with a collision detection system of claim 13, further comprising a bracket coupled to the hanger, wherein the proximity switch is coupled to the bracket.

17. The locking actuator with a collision detection system of claim 13, further comprising a bracket coupled to the hanger, wherein the spring engages the bracket and the clevis to urge the cylinder toward the at-rest position.

* * * * *